United States Patent [19]

Salice

[11] 4,011,627

[45] Mar. 15, 1977

[54] ADJUSTABLE HINGE COUPLING OR THE LIKE

[75] Inventor: Luciano Salice, Carimate, Italy

[73] Assignee: Arturo Salice SpA, Cantu (Como), Italy

[22] Filed: June 2, 1976

[21] Appl. No.: 692,116

[30] Foreign Application Priority Data

June 3, 1975 Italy ..... 21594/75

[52] U.S. Cl. ..... 16/129

[51] Int. Cl.[2] ..... E05D 7/04

[58] Field of Search ..... 16/129–134, 16/149, 179, 180, 163, 182, 190, 164, 139, 145, 146, 142, 183

[56] References Cited

UNITED STATES PATENTS

| | | | |
|---|---|---|---|
| 3,890,670 | 6/1975 | Bachor et al. | 16/129 |
| 3,938,219 | 2/1976 | Rock et al. | 16/130 |
| 3,952,366 | 4/1976 | Rock et al. | 16/129 |

*Primary Examiner*—G. V. Larkin

*Attorney, Agent, or Firm*—Karl F. Ross; Herbert Dubno

[57] ABSTRACT

A mounting for a hinge or the like has a generally rectangular base with a longitudinal rib received in a longitudinally coextensive but transversely enlarged recess of a generally rectangular cover which can be laterally shifted on the rib and secured to it in a selected relative position. The longitudinal edges of the cover, spaced from the base, are engaged by inbent lips of a channel-shaped slider embracing the cover, this slider being immobilizable in a selected longitudinal position by two longitudinally spaced screws; thanks to a curving of the aforementioned edges away from the base, selective tightening of the screws enables the slider to be fastened to the cover in different positions of relative inclination whereby an extremity of that member is independently adjustable in three dimensions with respect to the base.

10 Claims, 8 Drawing Figures

ADJUSTABLE HINGE COUPLING OR THE LIKE

FIELD OF THE INVENTION

My present invention relates to an adjustable coupling for hingedly or otherwise interconnecting two relatively movable elements such as, for example, a door and a frame on a cabinet or similar piece of furniture.

BACKGROUND OF THE INVENTION

In the case of mass-produced cabinets or the like, the door hinges must be individually adjusted to compensate for unavoidable manufacturing tolerances. Such adjustment is generally required in three dimensions and, if the door has two hinges as is usually the case, must be carried out on both hinges together. Though three-dimensionally adjustable hinge mountings are already known, they generally suffer from various disadvantages including:

a. difficulty of installation;

b. undesirable correlation between adjustments in different dimensions, requiring repeated readjustments in small increments;

c. coordination of these readjustments between two hinges to be installed simultaneously;

d. complex construction and correspondingly high manufacturing costs;

e. instability of the selected adjustment.

OBJECTS OF THE INVENTION

The general object of my present invention, therefore, is to provide an improved coupling of the character referred to which obviates the aforestated disadvantages.

A more particular object is to provide a coupling of this description which can be independently adjustable in all three dimensions so that an alignment already achieved in one dimension is not vitiated by a subsequent adjustment in a different dimension.

Another more specific object is to provide a simple, inexpensive yet stable construction for such a coupling, enabling it to be rapidly installed and adjusted.

SUMMARY OF THE INVENTION

A three-dimensionally adjustable coupling according to my invention comprises two relatively movable components which are to be secured to respective elements to be interconnected thereby, one of these components being a simple connector while the other is a composite mounting for that connector which may be considered stationary even through this is not essential. The composite mounting includes a base securable to the associated element, a cover engageable with that base and shiftable relatively thereto in a first dimension until immobilized by first fastening means, and a slider engageable with the cover and shiftable relatively thereto in a second dimension with limited relative mobility in a third dimension until immobilized with reference to the cover by second fastening means. The other component, i.e., the connector, is displaceably joined to the slider, e.g., through the intermediary of a quadrilateral linkage comprising two straps anchored to respective pairs of pins on the slider and the connector as is well known per se.

Advantageously, the base is of generally rectangular outline and has a longitudinal rib rising from one of its surfaces, that rib being received with close longitudinal fit in a recess of the cover which is also of generally rectangular outline. With the rib narrower than the recess, the cover is transversely shiftable on the base upon release of the first fastening means which may comprise a single screw passing through the cover into engagement with the rib. The cover has a pair of longitudinal edges held separated from the base surface by virtue of the fact that the depth of the recess is less than the height of the rib, these longitudinal edges being underreached by a pair of inbent lips of the slider which is designed as a channel profile embracing the cover. The limited relative mobility of the slider and the cover is given by a certain play provided between the longitudinal cover edges and the underreaching slider lips.

Pursuant to a further feature of my invention, the play between the lips and the longitudinal edges comes into existence on account of the nonlinear shape of these edges which are bent or curved in such a way that their opposite extremities are tangent to two imaginary planes including an obtuse angle with each other. Owing to this nonlinearity, the edges of the cover bear upon the lips of the slider only along part of their length, the point of engagement between the edges and the lips being shiftable by the second fastening means so as to let the slider rock relatively to the base in a longitudinal plane perpendicular to the base surface. The second fastening means, designed to establish both the longitudinal and the angular position of the slider relative to the cover independently of each other, may simply comprise a pair of screws threaded into the slider at longitudinally spaced-apart locations, these screws bearing upon the cover in a direction substantially perpendicular to the aforementioned base surface.

BRIEF DESCRIPTION OF THE DRAWING

The above and other features of my invention will now be described in detail with reference to the accompanying drawing in which.

SPECIFIC DESCRIPTION

Figures 1, 2, 3, 4, 5, 6, 7, 8:
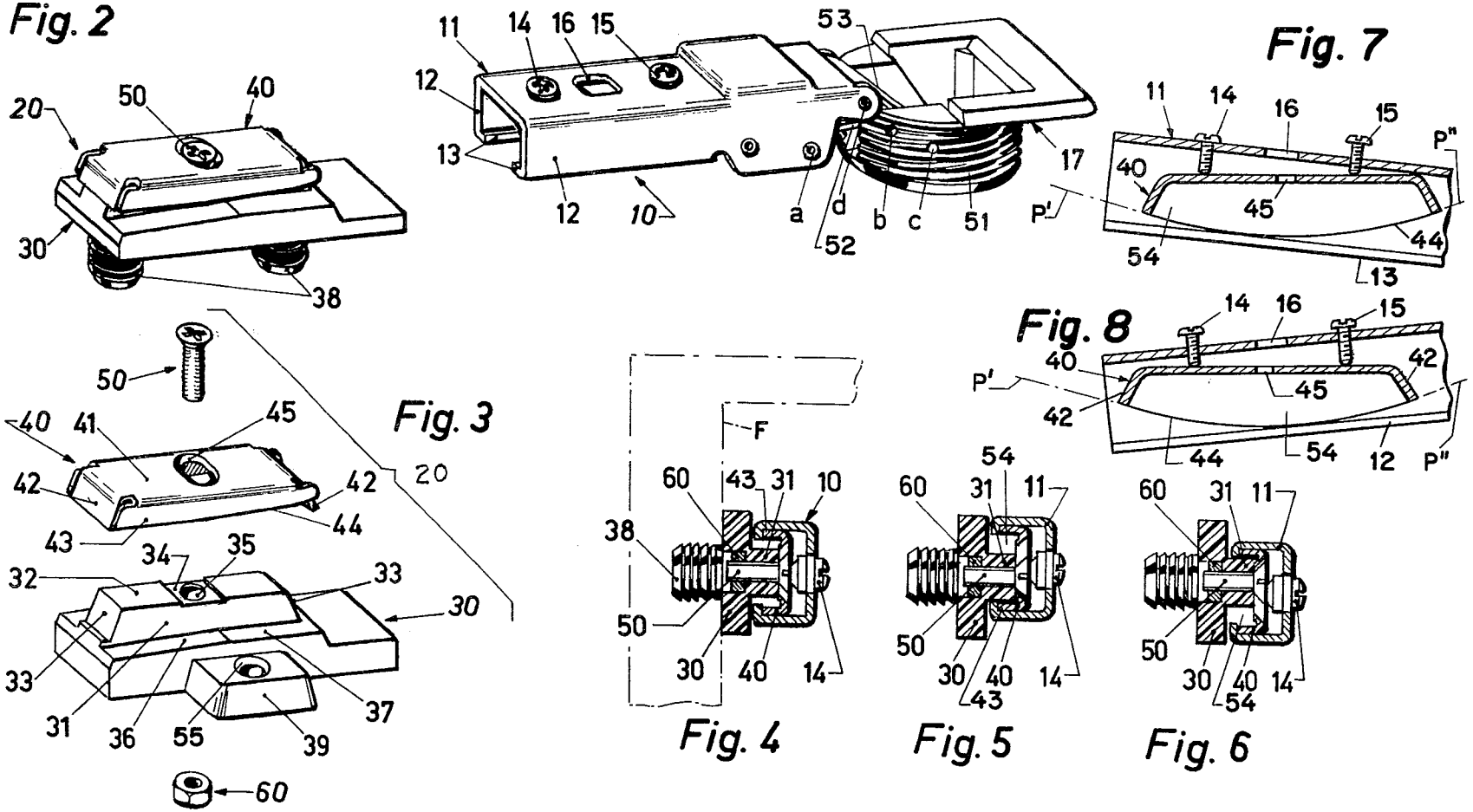
FIG. 1 is an isometric view of a three-dimensionally adjustable hinge coupling according to my invention, with omission of a base and a cover forming part of its fixed component.
FIG. 2 is an isometric view of the base and the cover forming part of the hinge coupling of FIG. 1.
FIG. 3 is an exploded isometric view of the cover and the base, the latter being slightly modified in comparison with FIG. 2.
FIGS. 4 – 6 are cross-sectional views of the fixed component of FIGS. 1 and 2, showing three different relative positions between the base and the cover.
FIGS. 7 and 8 are longitudinal sectional views of the fixed component (with the base omitted) in two different positions of adjustment.

The hinge coupling shown in FIG. 1, embodying my present invention, comprises a stationary component 10 and a movable component 17, the latter having a threaded boss 51 which may be fastened to a door, a lid, a dropleaf or any other swingable element of a piece of furniture, for example, that is to be hinged to a frame element or the like of that piece. Component 10, of which only a slider 11 has been illustrated in FIG. 1, is joined to component 17 by a quadrilateral linkage including a pair of parallel pins *a* and *d* on an extremity of the slider 11 and a pair of similar pins *b* and *c* within the tubular boss 51; a strap 51 is anchored to pins *a* and

*b* whereas another strap 53 is anchored to pins *c* and *d*. With this conventional linkage, component 17 may be swung through an arc of 90° or more relatively to slider 11.

Two other members of stationary component 10, shown in FIGS. 2 – 6, are a base 30 and a cover 40 together constituting a subassembly 20. Members 30 and 40 are held together, in a manner more fully described hereinafter, by first fastening means including a screw 50; the slider 11 and the subassembly 20 are relatively immobilizable by second fastening means comprising a pair of longitudinally spaced-apart screws 14 and 15 threaded into the top of slider 11 which is a channel profile of generally C-shaped cross-section with flanks 12 terminating in a pair of inbent longitudinal lips 13.

The top 41 of cover 40 has a transverse slot 45 accommodating the screw 50. Cover 40, advantageously formed from sheet metal, has end flaps 42 and sidewalls 43 together defining a generally rectangular recess 54 which embraces a longitudinal rib 31 rising from an upper surface of base 30, this surface having a slightly sloping part 36 and a substantially horizontal part 37. Rib 31, which is narrower than recess 54 as best seen in FIGS. 4 – 6, has sloping end faces 33 and vertical lateral faces; its top 32 is centrally recessed at 34 and formed in that recess with a bore 35 receiving the stem of screw 50. A nut 60, shown in FIGS. 3 – 6, is lodged in the body of the base 30 below recess 34 in line with bore 35 for engagement with the screw 50, the base being in this case molded from plastic material. With a metallic base, threads complementary to those of screw 50 could be cut directly into the wall of bore 35, thus obviating the need for a separate nut 60.

The flaps 42, whose slope parallels that of the end faces 33 of rib 31, are in direct contact with these end faces so as to establish a fixed relative longitudinal position between the base 30 and the cover 40. As the recess 54 is relatively shallow, compared to the height of rib 31, the sidewalls 43 of cover 40 do not reach the base surface 36, 37 but are separated therefrom by a clearance varying from one end of the rib 31 to the other, this variation being due in part to the relative inclination of surface portions 36, 37 and in part to the nonlinearity of the bottom edges 44 of sidewalls 43. Thus, as best seen in FIGS. 7 and 8, these bottom edges 44 are so curved that their opposite extremities are tangent to a pair of imaginary planes P′ and P″ including a large obtuse angle with each other.

FIGS. 7 and 8 show how the edges 44 of cover 40 come to rest on the inbent lips 13 of the channeled slider 11 in the assembled condition thereof. Depending on the setting of the two fastening screws 14 and 15, the right-hand extremity of slider 11 linked with connector 17 (FIG. 1) can be either lowered (FIG. 7) or raised (FIG. 8) with reference to base 30. With a continuous curvature of edges 44, as shown, the elevation of the hinged slider extremity relative to base 30 is infinitely adjustable; a limited number of adjustment positions would be available if these edges were divided into angularly adjoining sections.

Between screws 14 and 15 the top of slider 11 is formed with an aperture 16 giving access to the underlying head of screw 50 in slot 45; aperture 16 should, of course, be wide enough to afford such access throughout the range of contemplated longitudinal adjustment of slider 11 relative to subassembly 20.

In FIGS. 2 and 4 – 6 the base 30 is shown provided with threaded studs 38, similar to the boss 51 of connector 17, by which that base may be fastened to the frame of a cabinet or the like, as diagrammatically illustrated at F in FIG. 4. Alternatively, as shown in FIG. 3, base 30 may be integral with a pair of lateral lugs 39 (only one visible) having bores 55 for the passage of nonillustrated mounting bolts.

Thus, the following three independent adjustments are possible with my improved hinge coupling:

I. Transverse displacement of cover 40 relative to rib 31, upon a loosening of screw 50. With componnent 10 mounted on the frame F as illustrated in FIG. 4, this adjustment raises or lowers the nonillustrated door leaf with reference to the frame, as will be apparent from a comparison of FIGS. 4 – 6. II. Longitudinal displacement of slider 11 with reference to subassembly 20, upon a loosening of screws 14 and 15. This adjustment determines the depth of penetration of the door leaf into the frame opening.

III. Rocking of slider 11 with reference to cover 40 by a loosening of one and a tightening of the other of the two adjustment screws 14, 15 (FIGS. 7 and 8). This will shift the door leaf horizontally within the plane of the frame opening.

The relative transverse positioning (I) of base 30 and cover 40 may be fixed before the assembly 20 is introduced into the slider 11, yet a corrective readjustment will be possible even thereafter thanks to the accessibility of screw 50 via aperture 16. The longitudinal positioning (II) may be carried out next, followed by an angular adjustment (III) and tightening of screws 14 and 15 to immobilize the slider 11 with reference to the cover 40. The relative swing of slider 11 and cover 40 is increased by the beveling of surface portion 36 of base 30.

The rockable mounting of slider 11 on cover 40 could also be achieved by curving the lips 13 rather than (or besides) the edges 44.

I claim:

1. An adjustable coupling for interconnecting two relatively movable elements, comprising:

a base securable to one of said elements;

a cover engageable with said base and shiftable relatively thereto in a first dimension;

first fastening means for immobilizing said cover with reference to said base in a selected relative position;

a slider engageable with said cover and shiftable relatively thereto in a second dimension with limited relative mobility in a third dimension;

second fastening means for immobilizing said slider with reference to said cover in a selected relative position; and a connector securable to the other of said elements, said connector being displaceably joined to said slider.

2. A coupling as defined in claim 1 wherein said base is of generally rectangular outline with a longitudinal rib rising from a surface thereof, said cover being of generally rectangular outline with a recess receiving said rib with close longitudinal fit, said rib being narrower than said recess whereby said cover is transversely shiftable on said base, said first fastening means passing through said cover into said rib.

3. A coupling as defined in claim 2 wherein the ends of said rib and of said recess are lands converging with corresponding slope in a direction away from said surface.

4. A coupling as defined in claim 2 wherein said recess has a depth less than the height of said rib whereby longitudinal edges of said cover are held separated from said surface, said slider being a channel profile embracing said cover and having a pair of inbent lips underreaching said longitudinal edges with play.

5. A coupling as defined in claim 4 wherein said longitudinal edges have opposite extremities tangent to two imaginary planes which include an obtuse angle with each other and bear upon said inbent lips only along part of their length, said second fastening means being operable to shift the points of engagement of said inbent lips with said longitudinal edges whereby said slider rocks relatively to said base in a longitudinal plane perpendicular to said surface.

6. A coupling as defined in claim 5 wherein said second fastening means comprises a pair of screws threaded into said slider at longitudinally spaced-apart locations and bearing upon said cover in a direction substantially perpendicular to said surface.

7. A coupling as defined in claim 6 wherein said slider is provided with an aperture between said pair of screws, said first fastening means comprising a further screw accessible through said aperture.

8. A coupling as defined in claim 7 wherein said cover is provided with a transverse slot traversed by said further screw.

9. A coupling as defined in claim 1 wherein said connector is articulated to an extremity of said slider.

10. A coupling as defined in claim 9 wherein said extremity of said slider and said connector are each provided with a pair of transverse pins, further comprising a pair of straps respectively linking the pins of said slider with the pins of said connector.

* * * * *